United States Patent [19]

Unsworth et al.

[11] 4,168,161

[45] Sep. 18, 1979

[54] MAGNESIUM ALLOYS

[75] Inventors: William Unsworth, Aspull; John F. King, Bury; Stephen L. Bradshaw, Bolton, all of England

[73] Assignee: Magnesium Elektron Limited, Swinton, England

[21] Appl. No.: 844,940

[22] Filed: Oct. 25, 1977

Related U.S. Application Data

[63] Continuation-in-part of Ser. No. 645,226, Dec. 29, 1975, abandoned.

[30] Foreign Application Priority Data

Dec. 30, 1974 [GB] United Kingdom ..... 56021/74

[51] Int. Cl.[2] ..... C22C 23/00

[52] U.S. Cl. ..... 75/168 J; 148/32.5; 148/161

[58] Field of Search ..... 75/168 R, 168 J; 148/161, 39.5

[56] References Cited

U.S. PATENT DOCUMENTS 3,039,868 6/1962 Payne ..... 75/168 J

*Primary Examiner*—M. J. Andrews
*Attorney, Agent, or Firm*—Karl W. Flocks

[57] ABSTRACT

Magnesium alloys having favorable mechanical properties at high temperatures contain silver, neodymium and thorium, the permissible content of neodymium varying inversely according to the content of the thorium. The alloys are subjected to solution heat treatment followed by ageing to give optimum properties.

21 Claims, 9 Drawing Figures

VARIATION OF STRESS WITH Ag AND Cu CONTENTS

VARIATION OF STRESS WITH Ag AND Cu CONTENTS

0·2% PROOF STRESS N/mm2

Figure 1:
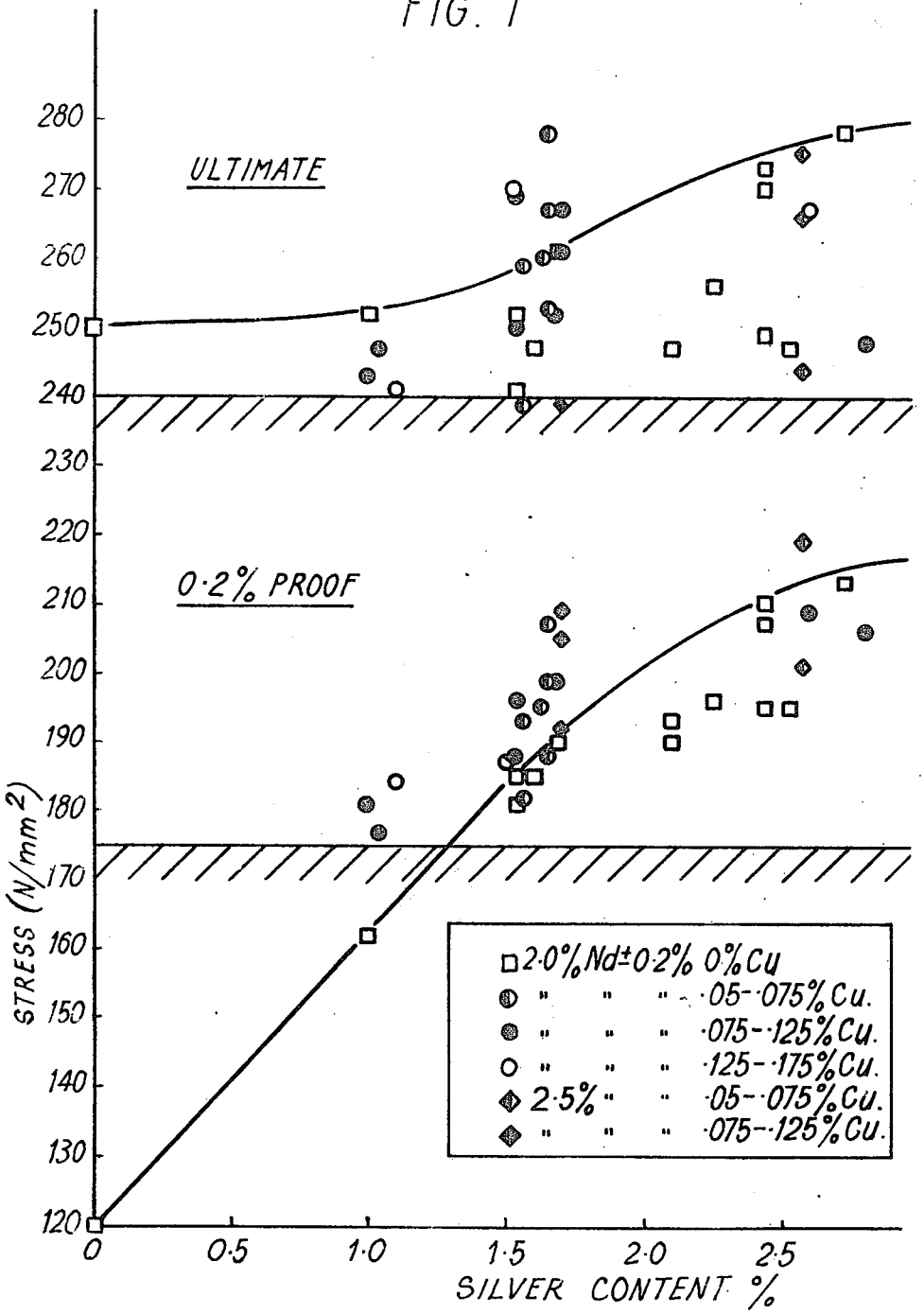

Nd%
Th%
A
B
C
D
2·5
2·0
1·5
1·0
0·5
0·5
1·0
1·5
2·0
2·5

ULTIMATE STRESS N/mm2

Nd%
Th%
2·5
2·0
1·5
1·0
0·5
0·5
1·0
1·5
2·0
2·5

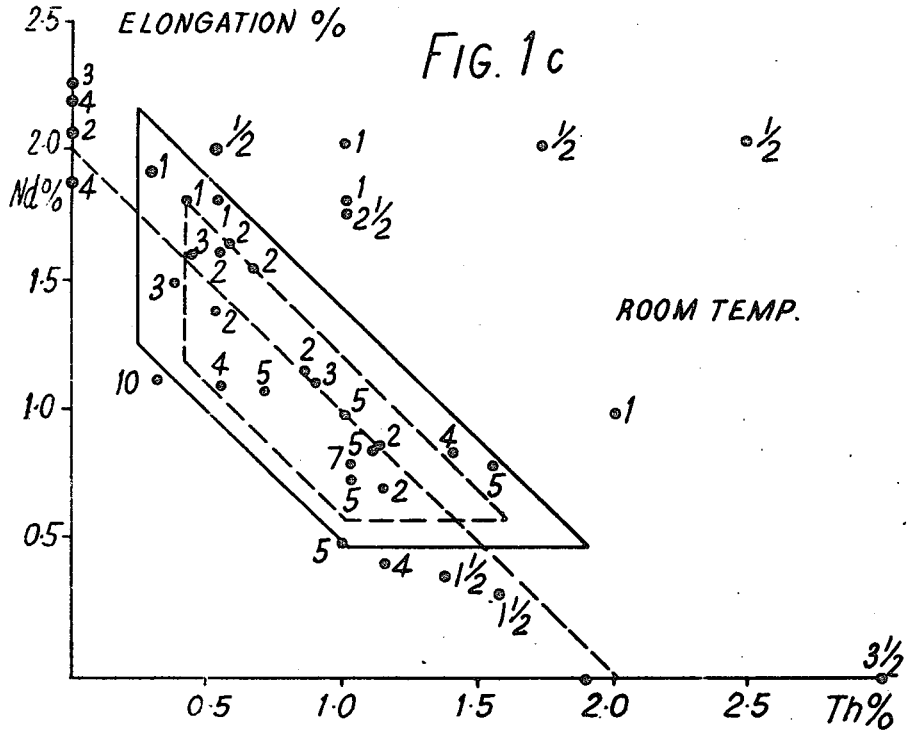
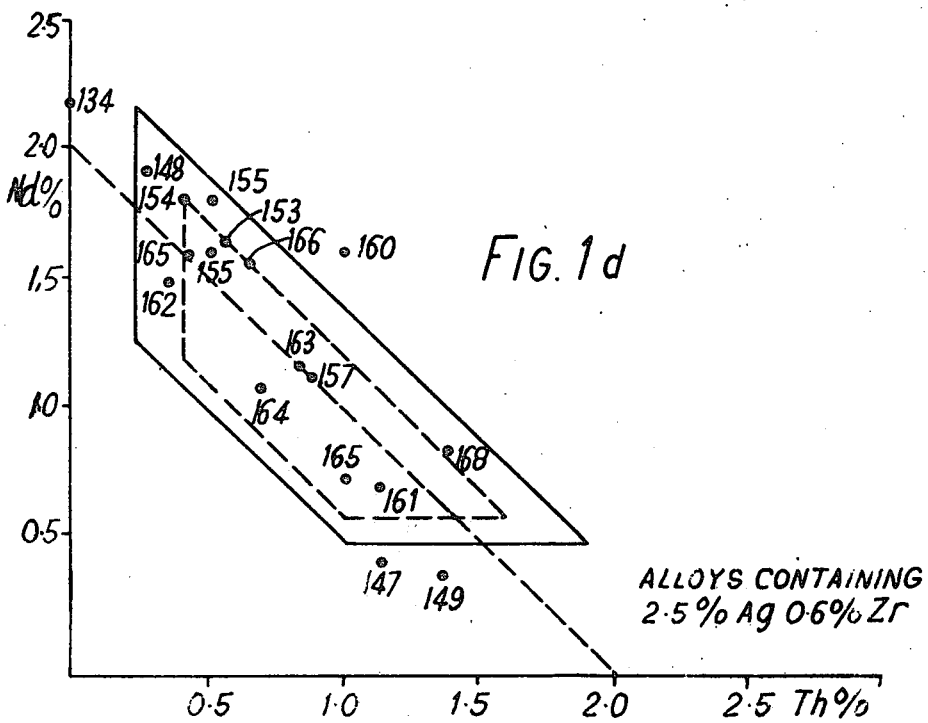
EFFECT OF Nd.Th ON TENSILE PROPS OF QEH ALLOYS

COMPARISON BETWEEN QE22 & QEH ALLOYS

COMPARISON BETWEEN QE22 & QEH ALLOYS.

MAGNESIUM ALLOYS

This application is a continuation-in-part of application Ser. No. 645,226 filed 12-29-75, now abandoned.

This invention relates to magnesium alloys.

magnesium alloys have a very low weight in comparison with alloys of other metals and accordingly find applications, particularly in the aerospace industry, where a low weight is important. Such alloys having advantageous mechanical properties, in particular a high proof stress, are described in U.S. Pat. No. 3,039,868 (Payne & Bailey). The alloys mentioned in U.S. Pat. No. 3,039,868 are described in more detail in an article by Payne & Bailey entitled "Improvement of the Age-Hardening Properties of Magnesium-Rare Earth Alloys by Addition of Silver" (Journal of the Institute of Metals, Vol. 88 1959–1960).

The alloys described in this prior art contain silver (generally from 1.5 to 3.5%) and rare earth metals. Two types of rare earth metal additions are discussed: (1) "mischmetal", a rare earth metal mixture consisting mainly of cerium and (2) "didymium", a mixture consisting mainly of neodymium and praseodymium. Payne & Bailey reported that the addition of thorium gives improved properties to such alloys containing mischmetal but that thorium is of no benefit when added to magnesium alloys containing silver and neodymium.

Alloys within the scope of this prior art have been used in aerospace components which are subject to relatively high stress, such as aircraft compressor housings, helicopter main gearboxes and undercarriage components. To obtain adequate mechanical properties it is necessary to subject these alloys to a two-stage heat treatment entailing solution treatment at a high temperature, followed by quenching and ageing at a lower temperature to improve the mechanical properties by precipitation hardening.

Mechanical properties thus obtained are well maintained during exposure to elevated temperatures up to 200° C. However, on exposure to temperatures above 200° C., mechanical properties deteriorate significantly, limiting the applications of such alloys in aircraft and other machinery, especially in engines and gearboxes operating in this temperature range.

There have now been found magnesium alloys having satisfactory tensile properties at room temperature which retain their advantageous properties, at least to some degree, at temperatures of the order of 250° C.

According to one aspect of the present invention, there is provided a magnesium-based alloy having a 0.2 proof stress of at least 148 N/mm2 at 250° C. containing the following constituents by weight (other than iron and other impurities):

| | |
|---|---|
| Silver | 1.25–3.0% |
| Rare earth metals, of which at least 60% is neodymium | 0.5–2.2% |
| Thorium | 0.2–1.9% |
| Zinc | 0–0.5% |
| Cadmium | 0–1% |
| Lithium | 0–6% |
| Calcium | 0–0.8% |
| Gallium | 0–2% |
| Indium | 0–2% |
| Thallium | 0–5% |
| Lead | 0–1% |
| Bismuth | 0–1% |
| Copper | 0–0.15% |
| Zirconium | 0–1% |

-continued

| | |
|---|---|
| Manganese | 0–2% |
| Remainder | Magnesium |

the maximum and permissible quantity of zirconium and manganese being limited by their mutual solubility and the total quantity of rare earth metal and thorium being from 1.5 to 2.4%.

It has been found, surprisingly, that considerably improved properties, especially tensile properties at elevated temperatures such as 250° C., may be obtained using restricted amounts of rare earth metals and thorium mentioned above. These properties do not require merely the presence of thorium and rare earth metals individually within certain maximum and minimum limits: in order to achieve improved properties the amount of each is dependent on the amount of the other. This reciprocal interaction of the rare earth metals (containing at least 60% neodymium) and thorium is an unexpected effect which is quite unknown in the prior art. It is believed that these elements in combination cause complex changes in the lattice parameters of the crystalline species present in the alloy which cannot be predicted with any certainty. The mechanical properties obtained are likewise unpredictable from the prior art.

In one embodiment of the invention the alloy contains less than 1% of thorium.

In a preferred embodiment of the invention the proportion of rare earth metals is 0.5–2.1% and the proportion of thorium is from 0.3 to 1.9%, the total amount of thorium and rare earth metals being 1.5–2.4%.

The alloys may be made using pure neodymium as the rare earth metal but as pure neodymium is very expensive it is preferred to add it in the form of a rare earth mixture containing at least 60% neodymium. The mixture of rare earth metals preferably contains not more than 25% of lanthanum and cerium taken together. It should be noted that yttrium is not classed as a rare earth metal.

In order to develop fully the tensile properties of the alloys of the invention it is necessary to subject them to heat treatment, firstly at a high temperature to achieve dissolution of the alloying constituents and then at a lower temperature to achieve "ageing" in which precipitation hardening takes place. The solution treatment should be carried out at a temperature from 485° C. to the solidus temperature of the alloy for a sufficient time to effect solution which may be at least 2 hours. The alloy may then be quenched to room temperature and then aged at a temperature from 100° C. to 275° C. for a period of at least ½ an hour; longer times are required at lower temperatures within the stated range.

In general a solution treatment of 8 hours at 525° C. is normally satisfactory. However the presence of copper in amounts of over 0.1% affects the solidus so that initial treatment at a temperature not exceeding 485° C., for example 8 hours at 465° C., is required before the higher temperature treatment.

It has been found that alloys having the abovementioned quantities of rare earth metals and thorium have advantageous properties both at room and at elevated (e.g. 250° C.) temperatures.

A preferred alloy according to the invention contains 2–2.5% silver, 0.9–1.4% rare earth metals, 0.6–1.1% thorium and at least 0.4% zirconium, the balance being magnesium. It has been found that the mechanical properties obtained are at an optimum within this range of compositions.

The desired amount of thorium may conveniently be added in the form of a magnesium-thorium hardener alloy.

The silver content has an effect on the properties of the alloy. The tensile properties deteriorate as the silver decreases although the elongation at fracture increases. The alloy should contain at least 1.25% of silver and the preferred range is from 1.5 to 3.0%.

The presence of up to 1% zirconium in the alloy is generally desirable to obtain satisfactory grain-refining. In order to obtain satisfactory castings it is desirable to incorporate at least 0.4% of zirconium. It may be desirable to add manganese, but the content of manganese is limited by its mutual solubility with zirconium. Part of the desirable minimum of 0.4% of the zirconium may be replaced by manganese.

Certain aspects of the invention are shown in the accompanying drawing, wherein

Figure 2:
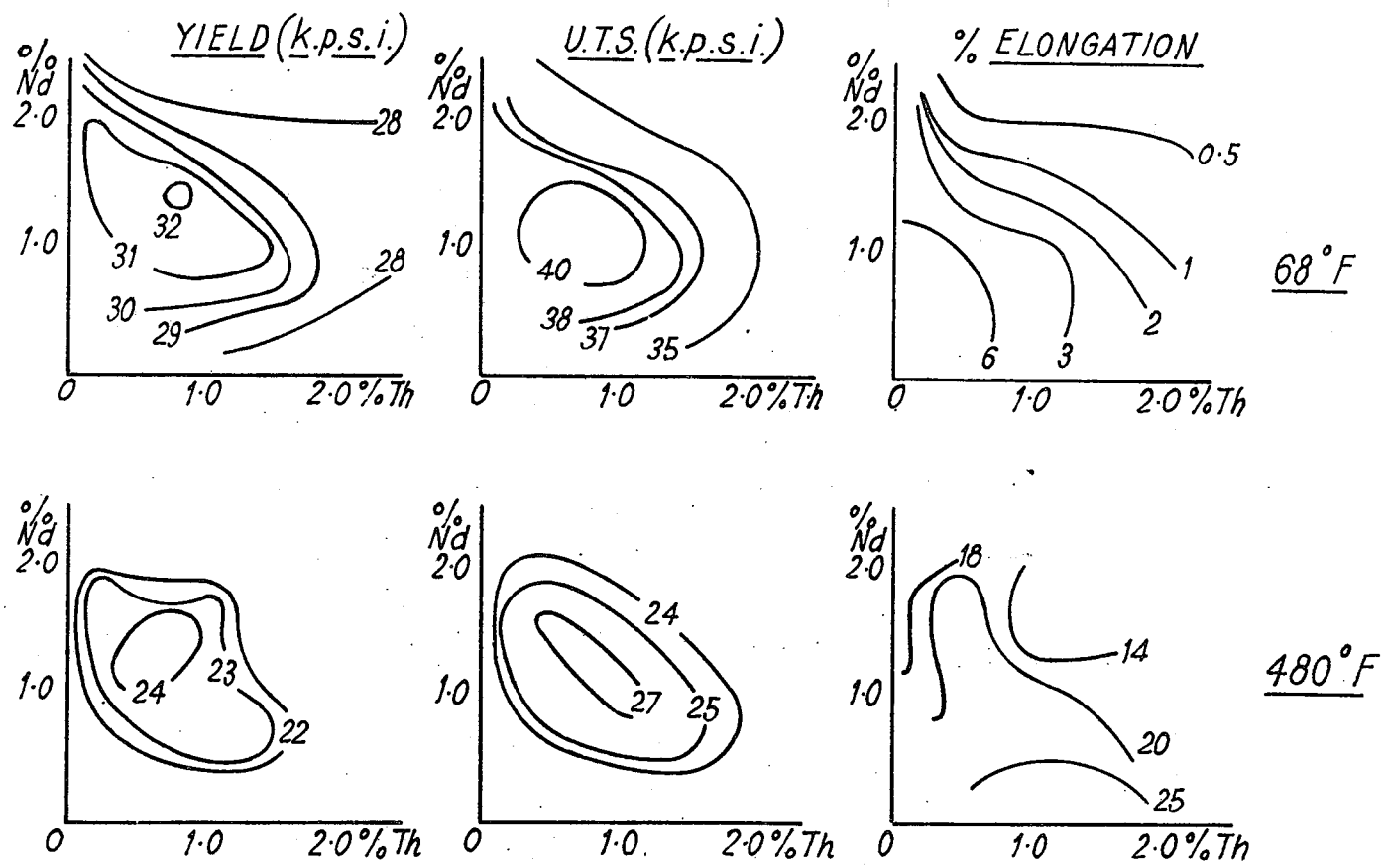
Figure 3:
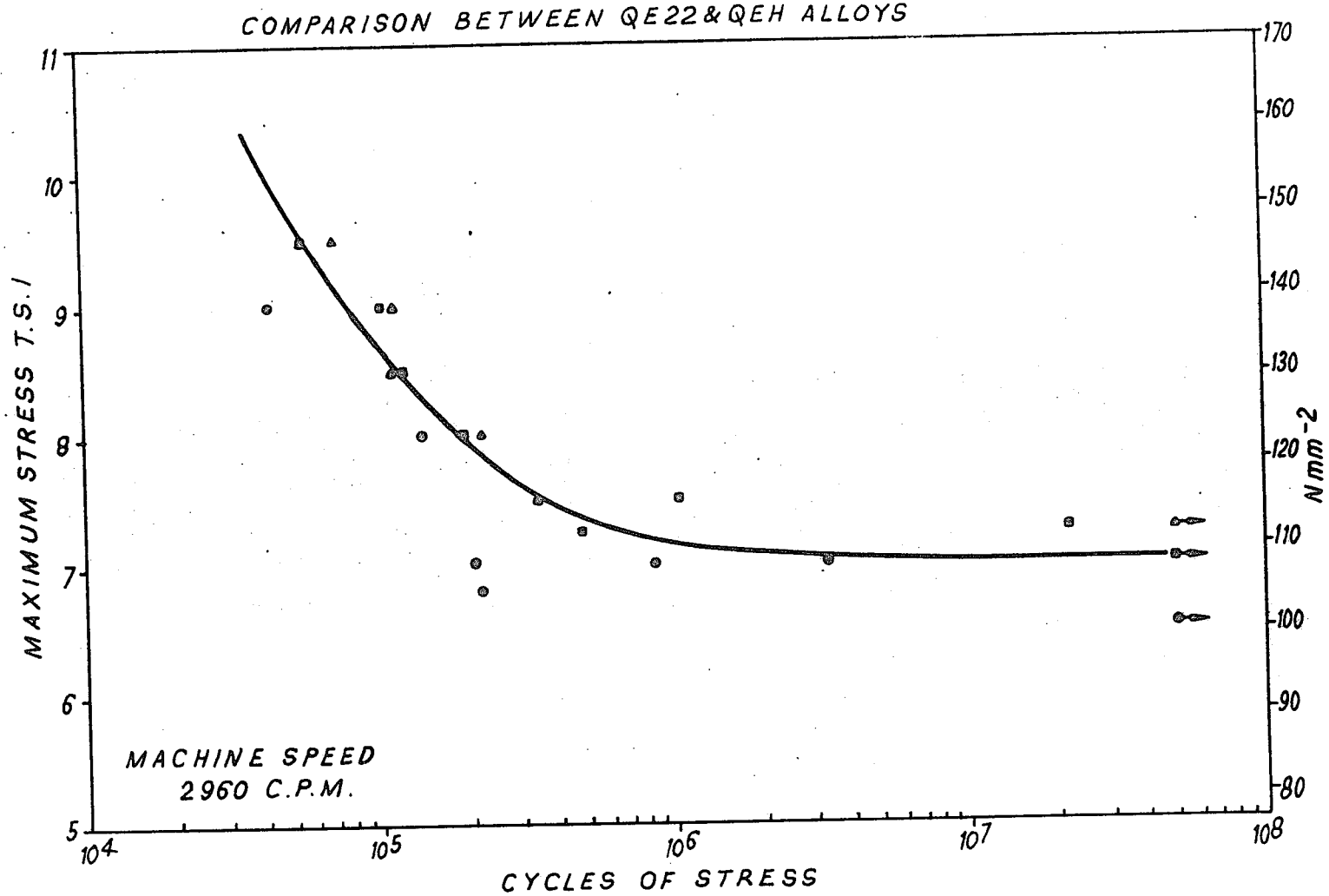
Figure 4:
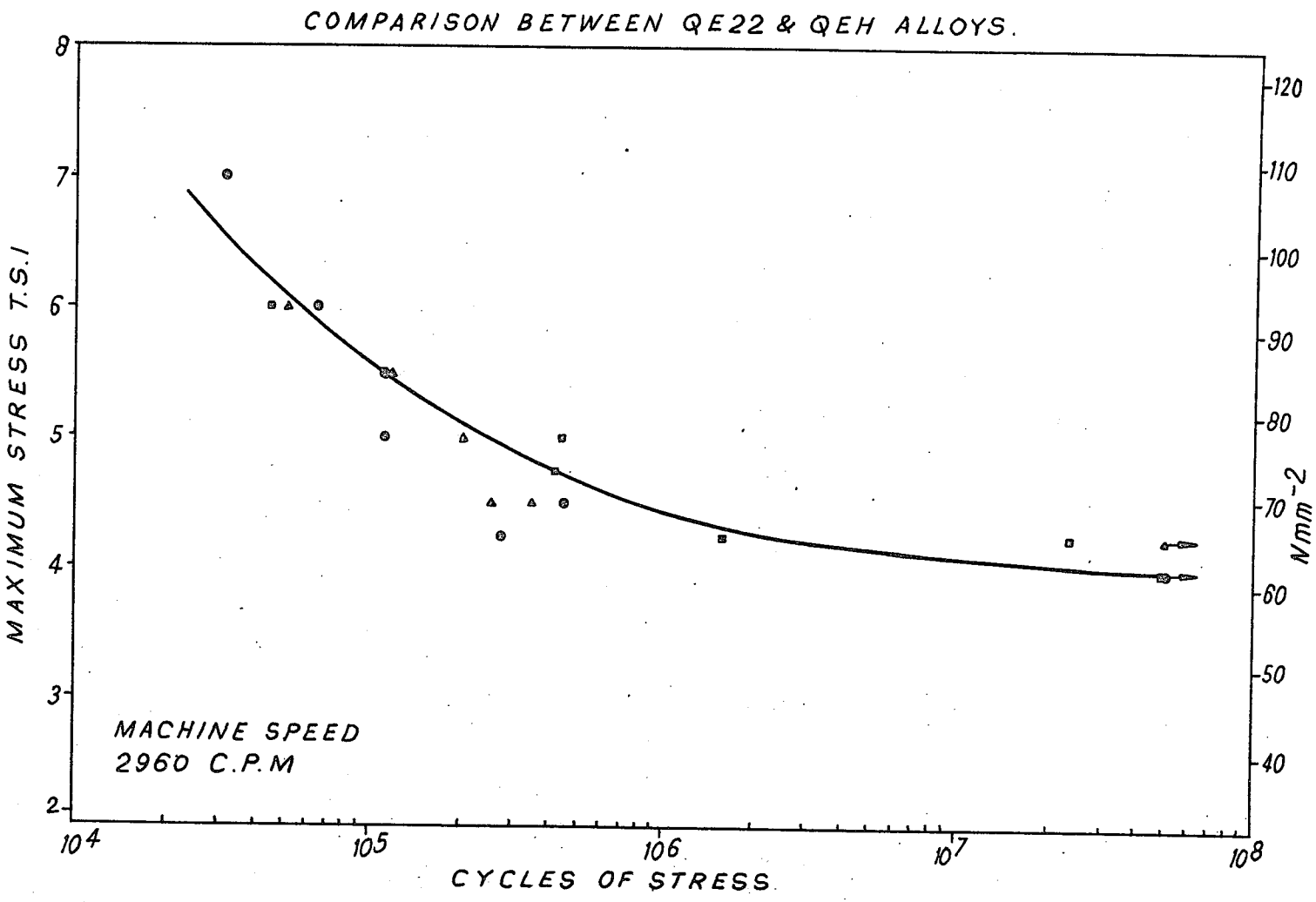

FIG. 1 gives the results of tensile property tests of various alloys, including some in accordance with the present invention;

FIG. 2 constitutes various curves in the form of contour plots showing various physical properties and;

FIGS. 3 and 4 show the results of Wohler fatigue tests for, respectively, un-notched and notched specimens.

Preferred embodiments of alloys according to the invention will be described in the following Examples.

EXAMPLES

Alloys having the compositions given below were made by a conventional method. Silver was added either as pure silver or from an ingot containing 2.5% Ag, 1.88% rare earths, Zr 0.36% and the rest magnesium. Rare earths were added as a magnesium/neodymium hardener alloy. Thorium was added as a magnesium/-thorium hardener alloy.

The alloys obtained were subjected to heat treatment initially at a high temperature to effect solution followed by quenching and ageing at a lower temperature. Initial solution treatment was carried out either for 8 hours at 525° C. or, for alloys containing significant amounts of copper, for 8 hours at 465° C. followed by 8 hours at 525° C. The specimens were then quenched in hot water and aged for 16 hours at 200° C.

The mechanical properties of the specimens thus obtained (0.2% proof stress, ultimate tensile stress and elongation) were measured at room temperature according to British Standard 18 and at 250° C. according to British Standard 3688. 15 minute soak times at 250° C. were used.

In order to investigate the over-ageing resistance of the alloys the same mechanical tests were carried out but with soak times varying from 15 to 120 minutes.

The fatigue resistance of the samples was measured using standard Wohler U-notched and un-notched fatigue tests. Creep behaviour was determined by plotting the stress/time relationship for 0.2% creep strain at 200° C. and 250° C. using a method according to British Standard 3600.

Figure 1A:
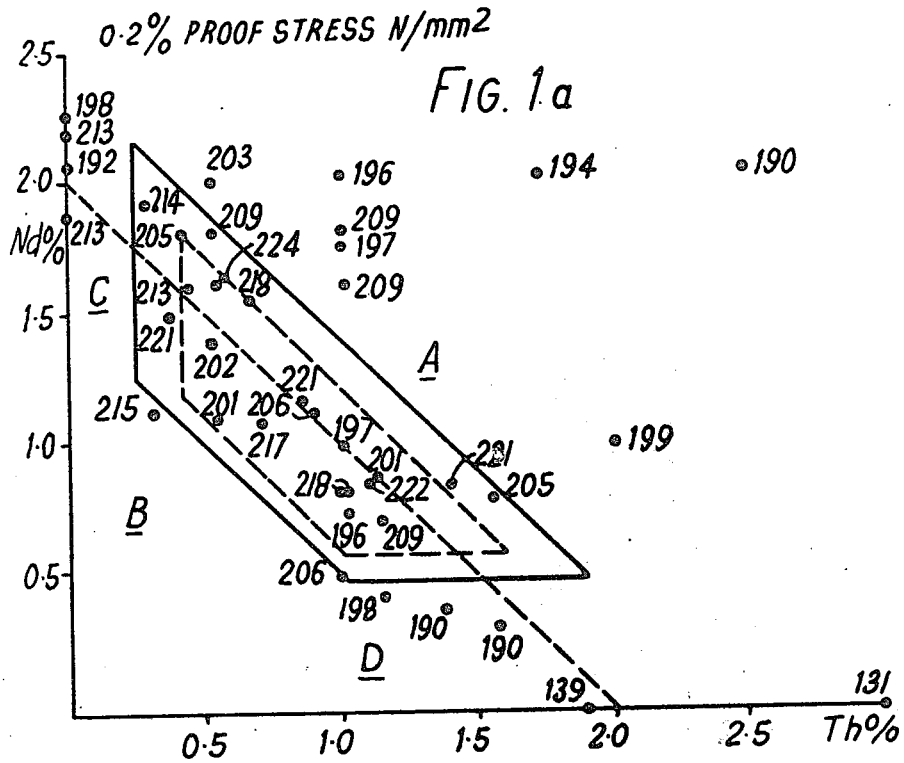
Figure 1B:
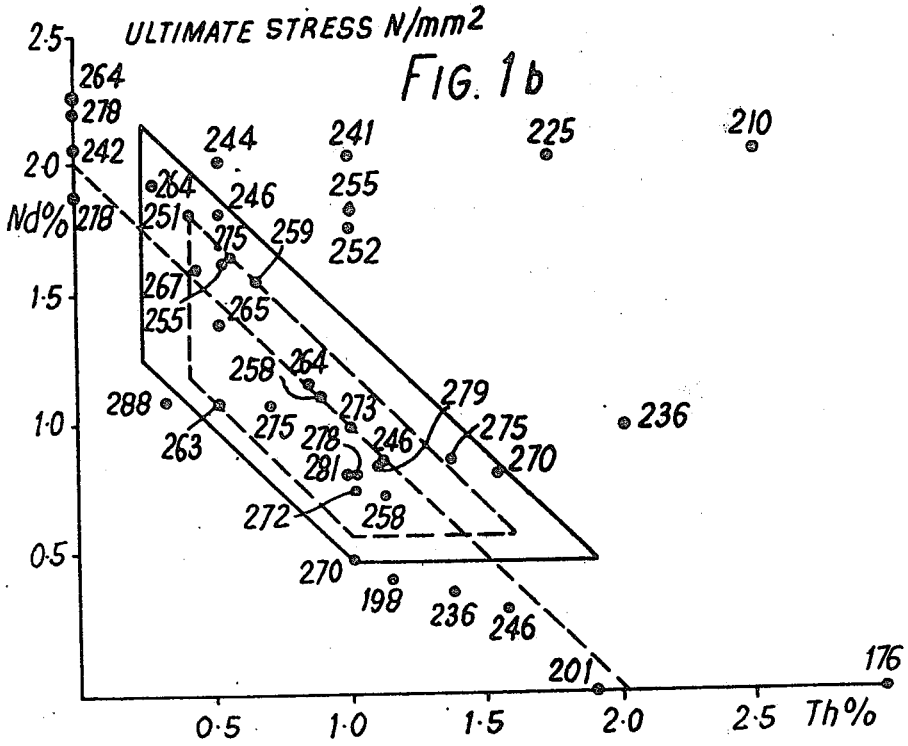
Figure 1E:
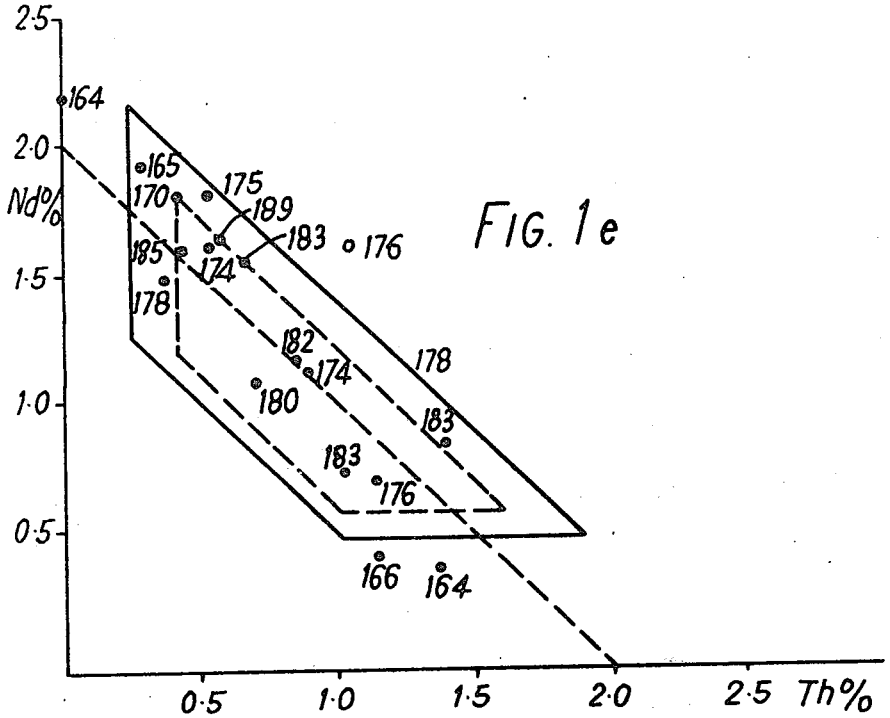
Figure 1F:
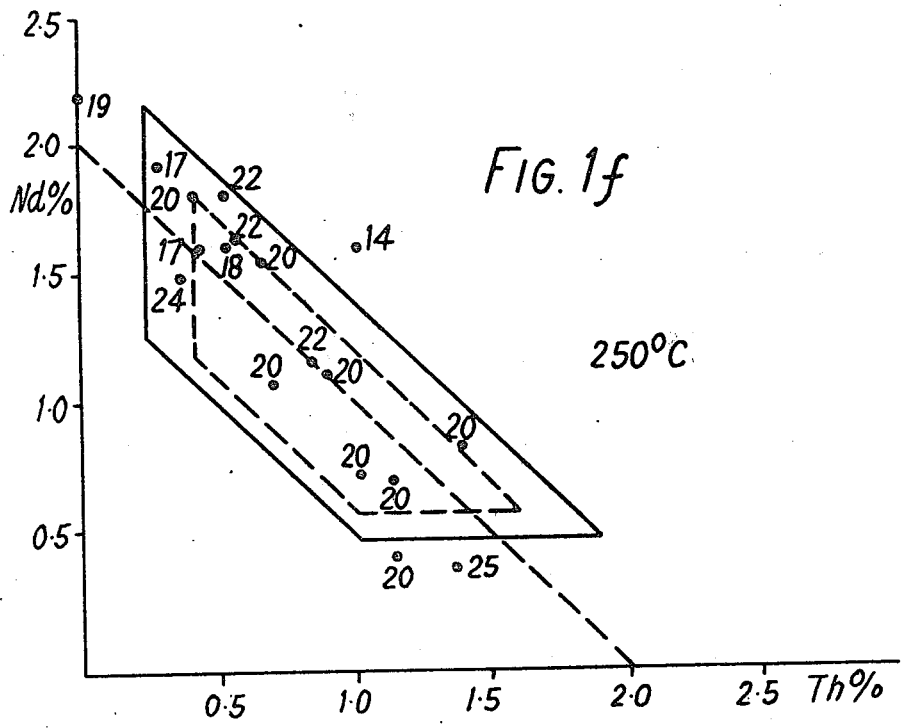

Results of the tensile property tests at 20° C. and 250° C. are given in FIG. 1 which relates to alloys containing 2.5% silver and 0.6% zirconium. FIGS. 1*a*, 1*c* and 1*e* show results at 20° C., while FIGS. 1*b*, 1*d* and 1*f* show results at 250° C. The rare earth metal content is plotted as ordinate and thorium content as abscissa.

The alloys within the scope of the present invention are within the trapezium shown on these plots. It will be seen from the values quoted within the trapezium that the alloys therein have favourable mechanical properties, and those outside are generally inferior. Thus alloys with increased total rare earth and thorium content (area A) have poorer room temperature elongation (plot c) and those with a rare earth content below 0.5% have lower proof stress and ultimate stress (plots (a), (b), (d) and (e)). Alloys having less than 0.2% thorium show inferior high temperature properties and those having a rare earth plus thorium content below 1.5% have been found to have inferior castability (more porosity).

The results of a large number of similar trials are shown in FIG. 2 in the form of contour plots showing 0.2% proof stress, ultimate tensile strength (recorded as K.p.s.i.) and elongation of 20° C. and 250° C. It is evident from these plots that all the tensile properties, at both combined and high temperature, are considerably inferior outside the trapezium defined by rare earth metals=0.5–2.2, Th=0.2–1.9 and (rare earth metals+Th)=1.5–2.4. If the requirement that rare earth metals+Th must not exceed 2.4 is withdrawn, most of the area of the plots then covered give alloys having much inferior properties. In all these alloys the silver content was from 1.25 to 3.0% by weight.

By way of comparison, the tensile properties of a magnesium alloy containing 2.1% silver, 1.1% of mischmetal, 1.7% of thorium and 0.6% of zirconium, heat treated and tested under similar conditions, is stated by Payne & Bailey (Table VI of U.S. Pat. No. 3,039,868) to give the following results:

| Testing Temperature | 0.1% Proof Stress ($N/mm^2$) | Ultimate Tensile Strength ($N/mm^2$) | Elongation |
|---|---|---|---|
| 20° C. | 166 | 249 | 4 |
| 200° C. | 142 | 176 | 11 |
| 250° C. | 129 | 156 | 18.5 |

It can be seen that the alloys of the present invention give greatly superior properties at both low and high temperatures in comparison with alloys containing thorium and mischmetal.

The effect of the thorium content on over-ageing resistance is shown in Table 1 below. It will be seen that the high temperature properties for a given degree of ageing are improved by the presence of thorium, and that these properties are substantially retained on over-ageing.

| ANALYSIS % | | | | Pre Soak at | PROPERTIES AT 250° C. | | |
|---|---|---|---|---|---|---|---|
| Ag | Rare Earths | Th | Zr | 250° C. (Mins) | Yield $Nmm^{-2}$ | U.T.S. $Nmm^{-2}$ | Elong. % |
| 2.65 | 1.62 | 0.58 | 0.57 | 15 | 154 | 185 | 23 |
| 2.33 | 1.41 | 0.84 | 0.52 | 15 | 168 | 183 | 20 |
| 2.72 | 2.22 | — | 0.53 | 15 | 134 | 164 | 19 |
| 2.65 | 1.62 | 0.58 | 0.57 | 60 | 153 | 181 | 14 |
| 2.72 | 2.22 | — | 0.53 | 60 | 122 | 150 | 21 |
| 2.33 | 1.41 | 0.84 | 0.52 | 120 | 169 | 181 | 16 |
| 2.72 | 2.22 | — | 0.53 | 120 | 127 | 149 | 20 |

The results of Wohler fatigue tests, respectively for un-notched and notched specimens, are shown in FIGS. 3 and 4. The alloys of these figures are as follows:

| Approximate analysis % | | | | |
|---|---|---|---|---|
| Ag | Rare Earths | Th | Zr | |
| 2.5 | 2.2 | — | 0.6 | Round dots |
| 2.5 | 0.6 | 1.3 | 0.6 | Square dots |
| 2.5 | 1.0 | 1 | 0.6 | Triangular dots |

It can be seen that the thorium-containing alloys show maximum stress values which are as good as or better than those of the alloy not containing thorium, especially for un-notched specimens.

The creep properties of specimens were measured at 200° C. and 250° C. The results were as follows:

| Composition % | | | | σ value (100 hours) for 0.2% creep strain N/mm² | |
|---|---|---|---|---|---|
| Ag | Rare earths | Th | Zr | 200° C. | 250° C. |
| 2.5 | 2.2 | 0 | 0.6 | 75 | 28 |
| 2.5 | 0.8 | 1 | 0.6 | 96 | 39 |

It can be seen that the creep properties of the thorium-containing alloy at elevated temperatures are considerably more favourable than those of the known alloy.

The addition of manganese has no deleterious effect on the tensile and creep properties of the alloy.

We claim:

1. A cast magnesium-based alloy which when heat treated has a 0.2 proof stress of at least 148 N/mm2 at 250° C. consisting essentially of the following constituents by weight: (other than iron and other impurities)

| | |
|---|---|
| Silver | 1.25–3.0% |
| Rare earth metals of which at least 60% by weight is neodymium | 0.5–2.2% |
| Thorium | 0.2–1.9% |
| Zinc | 0–0.5% |
| Cadmium | 0–1% |
| Lithium | 0–6% |
| Calcium | 0–0.8% |
| Gallium | 0–2% |
| Indium | 0–2% |
| Thallium | 0–5% |
| Lead | 0–1% |
| Bismuth | 0–1% |
| Copper | 0–0.15% |
| Zirconium | 0–1% |
| Manganese | 0–2% |
| Remainder (except impurities) | Magnesium |

the maximum and permissible quantity of zirconium and maganese being limited by the mutual solubility thereof and the total quantity of rare earth metals containing at least 60% neodymium and thorium being from 1.5 to 2.4%.

2. An alloy according to claim 1, containing at least 0.3% by weight of thorium and 0.5–2.1% of said rare earth metal containing at least 60% neodymium.

3. An alloy according to claim 1, containing less than 1% by weight of thorium.

4. An alloy according to claim 1, containing at least 0.4% by weight of zirconium.

5. An alloy according to claim 1, containing at least 0.4% by weight of zirconium and manganese taken together.

6. An alloy according to claim 1 which contains at least 1.5% of silver by weight.

7. An alloy according to claim 6, which contains from 2 to 2.5% by weight of silver, from 0.9 to 1.4% by weight of rare earth metals, from 0.6 to 1.1% by weight of thorium and at least 0.4% by weight of zirconium.

8. An alloy according to claim 1, which is shaped and further subjected to solution heat treatment at a temperature from 485° C. to the solidus of the alloy, to quenching and then to aging at a temperature from 100° C. to 275° C. for a period of at least ½ an hour.

9. An alloy according to claim 8, solution heat treated at a temperature of about 525° C. for 8 hours.

10. An alloy according to claim 8 containing at least 0.1% by weight of copper and solution heat treated at a temperature not exceeding 485° C. followed by treatment at a higher temperature.

11. An alloy method according to claim 8 in which the alloy is aged at a temperature of about 200° C. for a period of about 16 hours.

12. An alloy according to claim 1 wherein said rare earth metals containing at least 60% neodymium contains not more than 25% total of lanthanum and cerium.

13. A cast and heat-treated magnesium-base alloy having a composition in accordance with claim 1.

14. A cast and heat-treated magnesium-base alloy having a composition in accordance with claim 2.

15. A cast and heat-treated magnesium-base alloy having a composition in accordance with claim 3.

16. A cast and heat-treated magnesium-base alloy having a composition in accordance with claim 4.

17. A cast and heat-treated magnesium-base alloy having a composition in accordance with claim 5.

18. A cast and heat-treated magnesium-base alloy having a composition in accordance with claim 6.

19. A cast and heat-treated magnesium-base alloy having a composition in accordance with claim 7.

20. A cast and heat-treated magnesium-base alloy having a composition in accordance with claim 12.

21. An alloy in accordance with claim 1 wherein the rare earth metals content (of which at least 60% by weight is neodymium) lies between 0.6% by weight and 1.8% by weight, the thorium content lies between 0.4% and 1.6% by weight and the total quantity of rare earth metals and thorium together lies between 1.6% and 2.2% by weight.

* * * * *

UNITED STATES PATENT AND TRADEMARK OFFICE

CERTIFICATE OF CORRECTION

PATENT NO. : 4,168,161

DATED : September 18, 1979

INVENTOR(S) : William Unsworth, John F. King and Stephen L. Bradshaw

It is certified that error appears in the above—identified patent and that said Letters Patent is hereby corrected as shown below:

Cancel Fig. 1 (not Figs. 1a through 1f).

The sentence starting at col.3, line 65, should be rewritten as follows: --Figs. 1a, 1b and 1c show results at 20°C, while Figs. 1d, 1e and 1f show results at 250°C.--

Col. 4, line 21, change "combined" to --room--.

Signed and Sealed this

*Twenty-fifth* Day of *November 1980*

[SEAL]

*Attest:*

SIDNEY A. DIAMOND

*Attesting Officer*

*Commissioner of Patents and Trademarks*